US010392855B2

(12) United States Patent
Kempfle

(10) Patent No.: US 10,392,855 B2
(45) Date of Patent: Aug. 27, 2019

(54) DOMESTIC APPLIANCE COMPRISING A DIFFERENTIAL PRESSURE SENSOR

(71) Applicant: BSH HAUSGERAETE GMBH, Munich (DE)

(72) Inventor: Stephan Kempfle, Ellzee (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/578,354

(22) PCT Filed: May 18, 2016

(86) PCT No.: PCT/EP2016/061077

§ 371 (c)(1),
(2) Date: Nov. 30, 2017

(87) PCT Pub. No.: WO2016/192990

PCT Pub. Date: Dec. 8, 2016

(65) Prior Publication Data

US 2018/0155975 A1 Jun. 7, 2018

(30) Foreign Application Priority Data

Jun. 2, 2015 (DE) ..... 10 2015 210 113

(51) Int. Cl.
*E05F 15/70* (2015.01)
*F25D 23/02* (2006.01)
(Continued)

(52) U.S. Cl.
CPC ..... *E05F 15/70* (2015.01); *F25D 17/047* (2013.01); *F25D 23/028* (2013.01);
(Continued)

(58) Field of Classification Search
CPC .... E05F 15/70; E05Y 2900/31; F25D 17/047; F25D 23/028; F25D 21/025; F25D 29/005; F25D 2700/02
(Continued)

(56) References Cited

U.S. PATENT DOCUMENTS 6,522,252 B2 * 2/2003 Horibe ..... G01L 19/0038 200/83 A
6,564,642 B1 * 5/2003 Clifford ..... G01L 9/0073 73/716
(Continued)

FOREIGN PATENT DOCUMENTS

DE 3412972 A1 10/1985
DE 102006061083 A1 6/2008
(Continued)

OTHER PUBLICATIONS

DE3412972 Translated Description, 3 pages (Year: 1985).*

*Primary Examiner* — Andrew M Roersma
(74) *Attorney, Agent, or Firm* — Laurence A. Greenberg; Werner H. Stemer; Ralph E. Locher

(57) ABSTRACT

A domestic appliance has a carcass, a door for closing an inner space, a differential pressure sensor having a sensor membrane for identifying a difference in pressure between an interior air pressure in the inner space and an exterior air pressure in an outer space, a door opening aid for assisting the door opening process, and a control unit for the door opening aid which is dependent on the detected difference in pressure. The control unit is configured to detect a pressure curve of the difference in pressure and to control the door opening aid depending on the pressure curve that has been detected.

16 Claims, 4 Drawing Sheets

(51) Int. Cl.
*F25D 29/00* (2006.01)
*F25D 17/04* (2006.01)

(52) U.S. Cl.
CPC ..... *F25D 29/005* (2013.01); *E05Y 2900/31* (2013.01); *F25D 2700/02* (2013.01)

(58) Field of Classification Search
USPC ..... 73/715
See application file for complete search history.

(56) References Cited

U.S. PATENT DOCUMENTS

| | | | | |
|---|---|---|---|---|
| 6,813,953 | B2 * | 11/2004 | Baba | G01L 19/0645 73/715 |
| 7,021,149 | B2 * | 4/2006 | Dannhauer | G01L 19/0609 73/716 |
| 7,538,401 | B2 * | 5/2009 | Eriksen | C23C 14/021 257/419 |
| 9,062,911 | B2 | 6/2015 | Keller et al. | |
| 2005/0092094 | A1 * | 5/2005 | Kussel | G01L 9/0089 73/730 |
| 2010/0307189 | A1 * | 12/2010 | Keller | F25D 17/047 62/449 |
| 2016/0116206 | A1 | 4/2016 | Kempfle et al. | |
| 2016/0363364 | A1 * | 12/2016 | Kempfle | F25D 17/047 |

FOREIGN PATENT DOCUMENTS

| | | | | |
|---|---|---|---|---|
| EP | 1790252 | A2 | 5/2007 | |
| JP | 2014134348 | A * | 7/2014 | |
| WO | WO-2008132246 | A2 * | 11/2008 | F25D 29/008 |
| WO | 2014198634 | A1 | 12/2014 | |

* cited by examiner

DOMESTIC APPLIANCE COMPRISING A DIFFERENTIAL PRESSURE SENSOR

BACKGROUND OF THE INVENTION

Field of the Invention

The present invention relates to a domestic appliance comprising a door-opening aid.

Electronic door-opening aids are frequently employed in modern domestic appliances such as domestic refrigerators in order to assist actively a door opening process initiated by a user. To do this, however, it is necessary to identify an intention of the user to open the door.

A differential pressure sensor, for example, which detects a push on the door in the event of a push opening operation, and detects a pull on the door in the event of a pull opening operation, can be used to identify an imminent door opening process. EP 1790252 B1 describes an example of a differential pressure sensor.

SUMMARY OF THE INVENTION

The object of the present invention is to provide a domestic appliance having an improved door-opening aid.

This object is achieved by the features of the independent claims. Advantageous developments are the subject of the dependent claims, the description and the figures.

The present invention is based on the finding that the above-mentioned object can be achieved by monitoring a plurality of pressure values output by a differential pressure sensor. The pressure profile rather than a single pressure value can thereby be used to identify the door-opening intention. If the pressure detected by the differential pressure sensor lies within predetermined boundaries, which define a pressure profile corridor, then a door-opening intention can be assumed and the door-opening aid is activated. If, however, the pressure profile detected by the differential pressure sensor leaves the predetermined pressure profile corridor then an unintentional operation on the door of the domestic appliance can be assumed, for example, and therefore the door-opening aid is not activated.

The present invention is based on the further finding that a door closure can cause pressure fluctuations in the area outside the domestic appliance that can cause a door-opening aid to actuate incorrectly when a differential pressure sensor is used. When the external pressure applied to the differential pressure sensor is damped, such fluctuations can be damped or attenuated. This reduces the probability of incorrect actuation of a door-opening aid as a result of external pressure fluctuations.

According to a first aspect, the invention relates to a domestic appliance comprising a carcass, a door for closing an internal space, a differential pressure sensor having a sensor membrane for detecting a pressure difference between an internal air pressure in the internal space and an external air pressure in an external space, a door-opening aid for assisting the door opening process and a controller for controlling the door-opening aid according to the detected pressure difference, wherein the controller is designed to acquire a pressure profile of the pressure difference, and to control the door-opening aid according to said acquired pressure profile.

The pressure profile is defined by the pressure output values from the differential pressure sensor, for instance within a predetermined time interval of 100 ms, 500 ms or 1 s. Thus the decision about activating the door-opening aid is made not on the basis of a single pressure value but instead on the basis of a pressure profile, i.e. on the basis of a pressure curve. In this context, said control includes activating the door-opening aid, deactivating the door-opening aid, not activating the door-opening aid and amplifying the effect of the door-opening aid.

According to one embodiment, the controller is designed to activate the door-opening aid if the acquired pressure profile lies within a predetermined pressure profile corridor. The pressure profile corridor can be defined, for example, by a lower pressure profile boundary and by an upper pressure profile boundary, which are specified. If the pressure profile lies within these boundaries and thus within the pressure profile corridor predetermined thereby, then it can be assumed that a door-opening intention exists and the door-opening aid can be activated.

The pressure profile corridor can be different for different door opening variants. In the case of an opening process initiated by pushing on the door (push), an increasing pressure can be assumed when a user pushes on the door. After the user releases the door, however, the pressure decreases. In this case, the pressure profile can rise, for example linearly, up to a pressure ceiling value, which represents a maximum pressure value. After reaching the maximum pressure value, i.e. immediately after the door is released, the pressure decreases, for example linearly. The door-opening aid is activated if such a pressure profile is acquired.

If, on the other hand, the door is opened by a pull on the door, then the pressure detected by the differential pressure sensor reduces linearly, for example, during the pull phase, which results in a negative pressure gradient. If a negative pressure profile of this type within the pressure profile corridor is acquired, then in the case of the pull opening variant it can likewise be assumed that a door-opening intention exists, and therefore the door-opening aid can be activated.

According to one embodiment, the controller is designed to compare a gradient of the acquired pressure profile with at least one gradient threshold value in order to identify whether the acquired pressure profile lies within a predetermined pressure profile corridor, and to activate the door-opening aid only when the acquired pressure profile lies within the predetermined pressure profile corridor. The gradient threshold value can be defined, for example, by a lower pressure profile boundary and/or by an upper pressure profile boundary. In the case of a push opening variant, the gradient of the gradient threshold value is positive in the initial pressure profile phase and then decreases with a negative gradient. In the case of the pull opening variant, the gradient threshold value has a negative gradient from the start. It is hence advantageously possible to take account of different opening scenarios having different associated pressure profiles.

According to one embodiment, the controller is designed to detect a gradient reversal of the acquired pressure profile, and to activate the door-opening aid if the gradient reversal is present. As mentioned above, the gradient reversal is expected for a push variant, and occurs immediately after the release of the door. The gradient reversal is defined by a maximum pressure value, which likewise can be detected. The door-opening intention is thereby identified in a particularly simple and reliable manner for a push opening.

According to one embodiment, the controller is designed to detect a positive gradient of the acquired pressure profile up to the gradient reversal, and to detect a negative gradient of the acquired pressure profile after the gradient reversal, and to activate the door-opening aid only when the positive gradient of the pressure profile and the negative gradient of the pressure profile lie within a predetermined pressure profile corridor. Hence, instead of individual pressure values, the profile of the pressure increase and of the pressure decrease is analyzed in order to activate the door-opening aid. Thus the entire pressure initiation process, which, for example according to the push variant, is initiated by pushing on the door, is monitored and analyzed. This advantageously prevents incorrect actuations of the door-opening aid.

According to one embodiment, the controller is designed to activate the door-opening aid or amplify the effect thereof in the event of an increase in a gradient of the acquired pressure profile. This case takes into account particularly advantageously the pull variant, in which the pressure difference and hence the gradient of the acquired pressure profile are negative. The door-opening aid for the pull variant can be activated when the detected negative pressure difference exceeds an absolute value.

According to one embodiment, the controller is designed to activate the door-opening aid if the pressure profile having negative pressure difference values drops below the pressure profile corridor. This advantageously identifies the door-opening intention for the pull opening variant, in which the pressure difference values are negative from the start because of the pressure exerted on the door, with the result that the pressure profile has a negative gradient from the start.

According to one embodiment, the sensor membrane comprises a first membrane side, which faces the internal space, and a second membrane side, which faces away from the internal space and is surrounded by a pressure damping chamber, and said pressure damping chamber is designed to damp the external air pressure at least partially.

Fluctuations in the external air pressure, which can arise during a door closure for example, are reduced by using the pressure damping chamber, whereby it is possible to prevent incorrect actuations of the door-opening aid. At the same time, the pressure-measuring sensor is operated in a smaller pressure range, whereby a finer resolution of the pressure differences can be achieved.

According to one embodiment, the differential pressure sensor is arranged in a carcass. The use of the pressure damping chamber also allows the differential pressure sensor to be arranged in any region of the carcass.

According to one embodiment, the pressure damping chamber encloses the second membrane side fully or at least partially. An at least partial enclosure of the pressure damping chamber by the second membrane side makes a slow pressure equalization possible between the interior of the pressure damping chamber and the area around the pressure damping chamber. The air pressure acting on the second membrane side can hence be adapted to atmospheric air pressure fluctuations. If, on the other hand, the second membrane side is fully enclosed then the pressure damping chamber provides a reference system at an always constant pressure.

According to one embodiment, the pressure damping chamber is designed to provide a reference pressure or to damp the external air pressure.

According to one embodiment, the pressure damping chamber comprises a pressure damping element, in particular a damping orifice or a damping stage, which is provided for monotonic pressure equalization between an interior of the pressure damping chamber and the external space. The monotonic pressure equalization ensures that an adjustment of the air pressure inside the pressure damping chamber can be adapted to atmospheric fluctuations in the air pressure outside the pressure damping chamber. It also ensures that non-monotonic, i.e. abrupt, gradients in the pressure are not transferred to the second membrane side.

According to one embodiment, the controller comprises a controller circuit board having an electrical circuit, and the controller circuit board forms a wall of the pressure damping chamber or closes the pressure damping chamber. The circuit board can form a cover to the pressure damping chamber, for example, wherein the design of the circuit boards means it must always be assumed that, for instance because of the contact-making vias in the circuit board, holes exist that can be used as damping orifices, whereby at least some pressure damping can be achieved. At the same time, less installation space is needed overall because the circuit board cannot be accommodated at a separate location. Furthermore, the connecting lines to the circuit board can be made shorter, which saves material. The side walls of the damping chamber, on which the circuit board acting as a cover can rest, can be formed, for example, by air seals or by other walls. Another advantage of this embodiment is that relatively small holes can be tolerated because these act as damping orifices. This also reduces the manufacturing costs.

According to one embodiment, the door can be opened by a mechanical push on the door, and the controller is designed to activate the door-opening aid in the event of an increase in the detected pressure difference, or the door can be opened by a mechanical pull on the door, and the controller is designed to activate the door controller in the event of a reduction in the detected pressure difference. Both the push variant and the pull variant can hence be implemented.

According to another aspect, the invention relates to a method for controlling an activatable door-opening aid for assisting an opening of an appliance door in a domestic appliance, which comprises a carcass, a door for closing an internal space, a differential pressure sensor having a sensor membrane for detecting a pressure difference between an internal air pressure in the internal space and an external air pressure outside the external space, wherein a pressure profile of the pressure difference is acquired within a time interval, and wherein the door-opening aid is activated according to the acquired pressure profile.

According to one embodiment, the controller activates the door-opening aid only when the acquired pressure profile lies within a predetermined pressure profile corridor.

Additional features of the method according to the invention follow directly from the functionality of the domestic appliance according to the invention.

BRIEF DESCRIPTION OF THE SEVERAL VIEWS OF THE DRAWING

Further exemplary embodiments are explained with reference to the accompanying drawings, in which.

DESCRIPTION OF THE INVENTION

Figure 1:
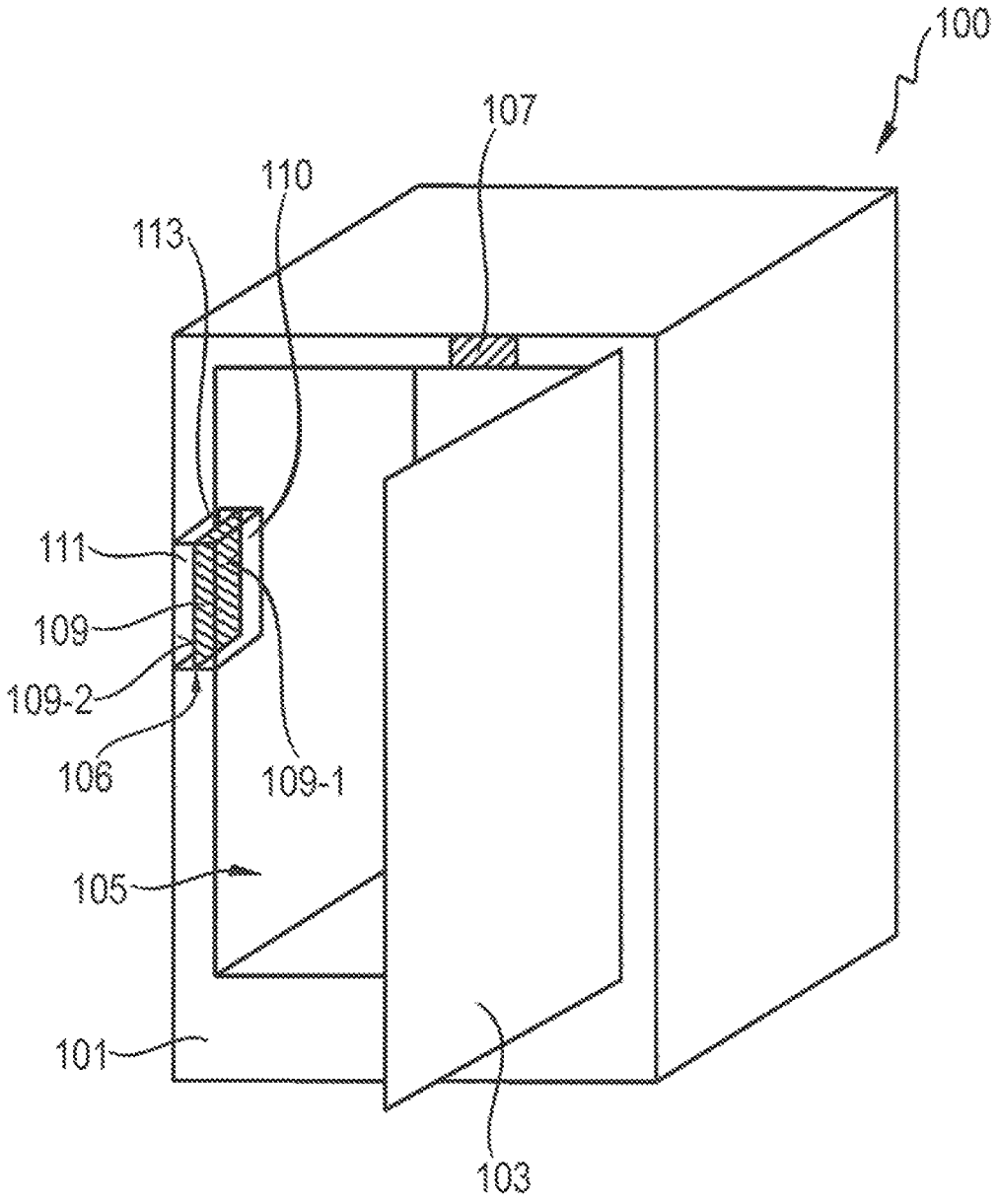
FIG. 1 is a schematic view of a domestic appliance comprising a door-opening aid.

FIG. 1 shows schematically a domestic appliance 100, which may be a domestic refrigerator for instance. The domestic appliance 100 has a carcass 101 and a door 103, which closes the internal space 105 of the carcass 101. In addition, an electrical door-opening aid 107 is provided in order to assist a door opening process. For this purpose, the door-opening aid 107 can comprise an actuator, which assists the door opening initiated by a user.

A differential pressure sensor 106 is provided in order to identify the door-opening intention. The differential pressure sensor 106 comprises a sensor membrane 109, which comprises a first membrane side 109-1 and a second membrane side 109-2.

The first membrane side 109-1 faces the internal space 105 and is exposed to the internal air pressure in the internal space 105. For this purpose, the first membrane side 109-1 can be arranged in a pressure chamber 110, which is shown schematically in FIG. 1 and is exposed directly to the internal pressure in the internal space 105.

The second membrane side 109-2, on the other hand, is arranged in a damping chamber 111, which is provided in order to damp an external air pressure at least partially. The second membrane side 109-2 is thereby exposed to a damped external air pressure, with the result that abrupt pressure fluctuations, for instance occurring during closure of the door 103, have no direct effect on the pressure measurement.

The damping chamber 111 can be completely closed, whereby a reference pressure is provided inside the damping chamber. The damping chamber 111 does not have to be completely closed, however, but can comprise one or more pressure equalization holes, for example, in order to allow a slow pressure equalization, for instance in the event of atmospheric fluctuations in the external air pressure. In both cases, the damping reduces a direct ambient effect on the sensor membrane 109, whereby it is possible to prevent incorrect pressure measurements.

If the pressure damping chamber 111 is not hermetically sealed, then the differential pressure sensor 106 damped in this way can adapt to the ambient pressure. A high resolution is thereby achieved, which can lie in a resolution range of 0.001 mbar for instance. The damping can confine the operating range of the differential pressure sensor 106 to a small pressure range, which facilitates the increased resolution. By the damped pressure equalization, the differential pressure sensor 106 hence operates always at or around the zero point in the resolution range and does not drift out of the measurement range in the event of higher ambient pressures.

The domestic appliance 100 also comprises a controller 113, which controls, for instance activates, the door actuator 107. According to one embodiment, the controller 111 is arranged on a circuit board, which as a cover closes the pressure damping chamber 111. This achieves damping of the air pressure, and at the same time can implement slow pressure equalization because of the holes that always exist in a circuit board and/or any imprecise fits, which have an advantageous effect in this case.

Although the pressure damping chamber 111 depicted in FIG. 1 is advantageous, it is not necessary for the signal analysis described below. Indeed the signal analyses described with reference to the exemplary embodiments shown in FIG. 2 and FIG. 3 can be used with any differential pressure sensors.

Figure 2:
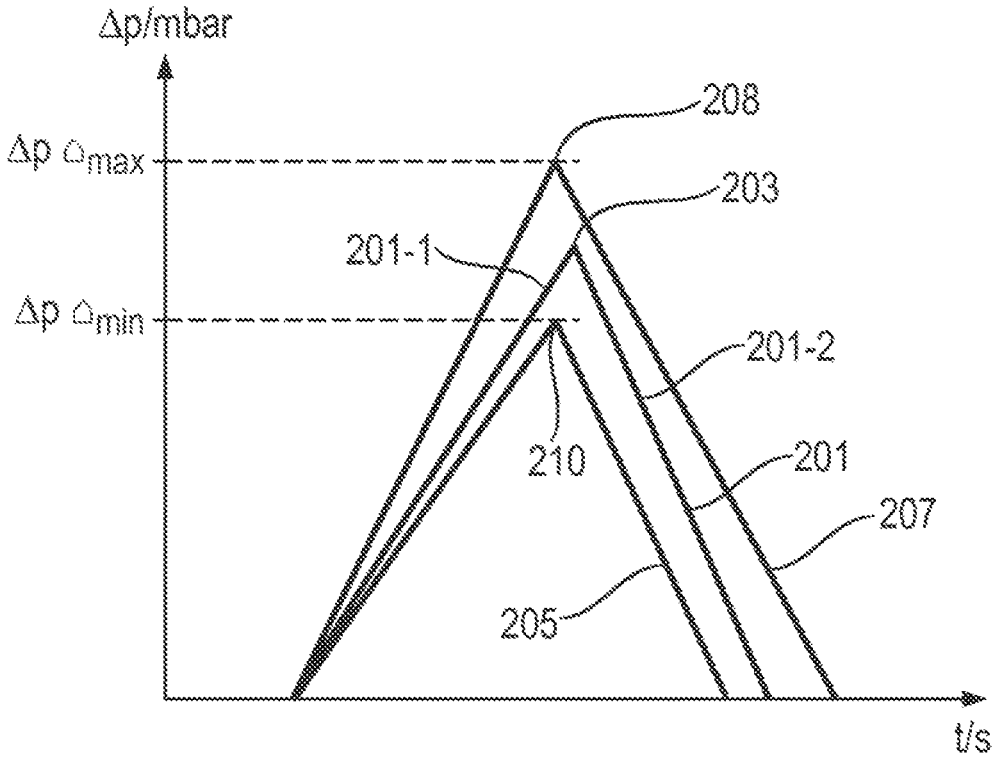
FIG. 2 shows an example of a pressure profile.

FIG. 2 shows an example of a pressure profile 201, which comprises a first pressure profile segment 201-1 having a positive gradient and a second pressure profile segment 201-2 having a negative gradient. The pressure profile 201 also has a gradient reversal point 203, which is defined by a detected maximum pressure value.

The pressure profile 201 is a differential pressure signal which, for example for the push variant, is obtained when there is an opening intention for which a user pushes on the door in order to initiate an opening process. The first pressure profile segment 201-1 occurs in the pushing phase until the maximum pressure 203 is reached. The second pressure profile segment 201-2 occurs during the release of the door 103 and the associated reduction in the differential pressure.

The controller 113 is preferably designed to acquire the pressure profile 201, and to control, for instance activate, the door-opening aid 107 according to the acquired pressure profile.

According to one embodiment, the controller 113 can be designed to form a running average of the differential pressure provided by the differential pressure sensor 106, whereby it is possible to monitor a signal gradient. The pressure profile segment 201-1 given by way of example is obtained when there is a positive signal gradient, i.e. during a pressure rise, whereas the second pressure profile segment 201-2 occurs when there is a negative signal gradient, i.e. during a fall in the differential pressure. According to one embodiment, the sensor signal provided by the differential pressure sensor 106, which signal gives a multiplicity of pressure values and hence indicates the pressure profile 201, can be digitized. If a gradient in the pressure profile 201 resulting from a pressure buildup on the appliance door 103 is identified, then an analysis can be performed as to whether the pressure profile, so for instance the gradient, lies within predetermined boundaries 205 and 207. Said boundary 205 is a lower pressure profile boundary, whereas the boundary 207 is an upper pressure profile boundary. The boundaries 205 and 207 define a pressure profile corridor in which the pressure profile 201 is meant to lie in order that the door-opening aid 107 is activated.

According to one embodiment, in order to activate the door-opening aid 107, in addition the maximum pressure value 203, i.e. the differential pressure ceiling value can be attained, whereafter the negative gradient of the pressure profile 201 then lies within the boundaries 205, 207. According to one embodiment, the boundaries 205, 207, i.e. the pressure profile corridor, form an envelope. If the pressure profile 201 lies inside the envelope then the door-opening aid 107 can be activated, whereby an actuator is started. According to one embodiment, the actuator can be started with a delay, thereby taking into account a sequence of movement of a user. The pressure profile corridor 205, 207, according to one embodiment, can take into account other gradients, for instance pressure-signal overshoots of the door or changes in the pressure signal rise, in order to minimize even further incorrect actuations of the door-opening aid 107.

According to one embodiment, opening-intention detection takes place within a span of 0.2 s or even faster. In this case, it is possible to take account of a superimposed pressure difference such as exists, for example, when a negative pressure is established after the door is closed. This can be done, for example, by shifting the differential pressure ceiling value and/or the boundaries 205, 207, whereby it is possible to adapt the pressure profile corridor to given conditions.

According to one embodiment, the analysis of the differential pressure profile 201 can be used to identify the opening and closing of the door 103.

The lower boundary 205 and the upper boundary 207 each have a differential pressure ceiling value 208, 210, each of which indicates a gradient reversal point 203.

Figure 3:
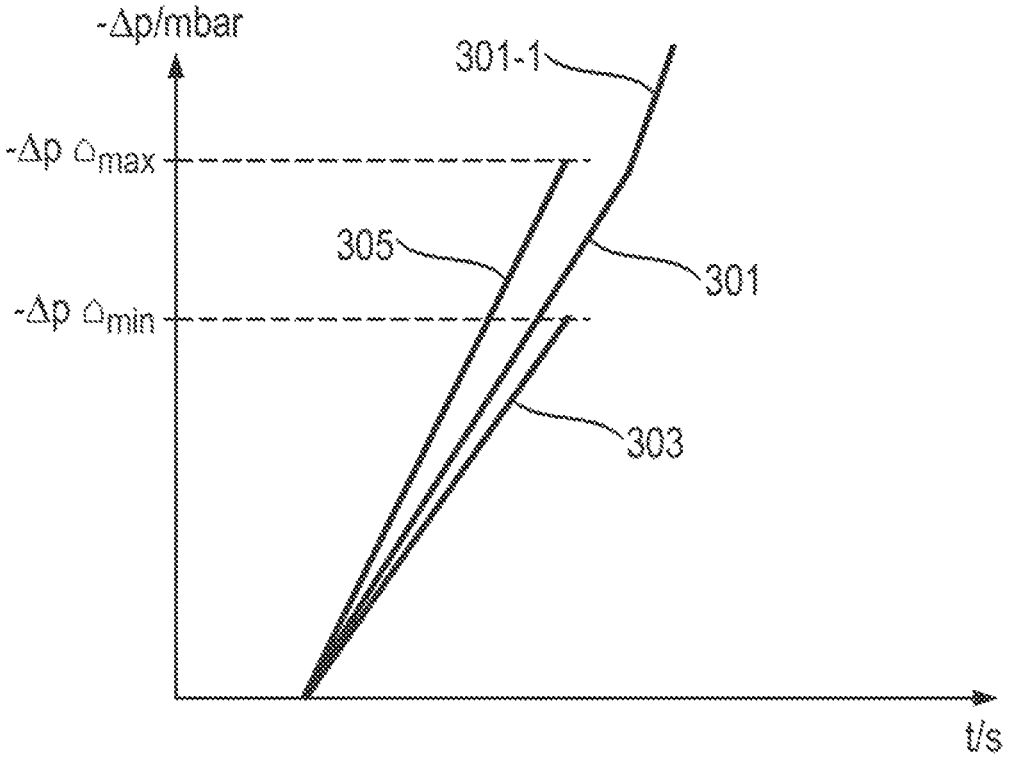
FIG. 3 shows an example of a pressure profile.

FIG. 3 shows a differential pressure curve 301, which is obtained in the pull scenario, in which the door 103 is opened by a pull on the door 103. In this case, the gradient of the differential pressure is negative, which is expressed in FIG. 3 by the depicted negative pressure values Δp. The gradient of the differential pressure profile 301 is hence negative. In this case, the pressure profile corridor is given by the lower pressure profile boundary 303 and the upper pressure profile boundary 305, which each have negative gradients. The door-opening aid 107 is activated when the differential pressure profile 301 is within the pressure profile boundaries 303, 305, i.e. within the pressure profile corridor 303, 305. As shown in FIG. 3, a steepening gradient of the differential pressure profile 301-1 can indicate the activation of the door-opening aid 107, i.e. the effect of additional actuator assistance, for as long as the door seal remains unbroken, for example.

Rapid detection of an opening intention, in which it is possible to distinguish between different forms of initiation, is thereby performed. It is thereby possible to prevent incorrect actuations of the door-opening aid 107, which might arise, for example, when the door is touched in other ways such as leaning on the door 103 or operating a control panel mounted on the door 103, for instance.

According to one embodiment, the pressure profile corridors 205, 207 and 303, 305 can be adjusted by additional parameters.

The user can thereby select, for example in a control panel of the controller 113 or in a control panel of the appliance controller, the pressure value at which the door-opening aid 107 is meant to be activated.

Figure 4:
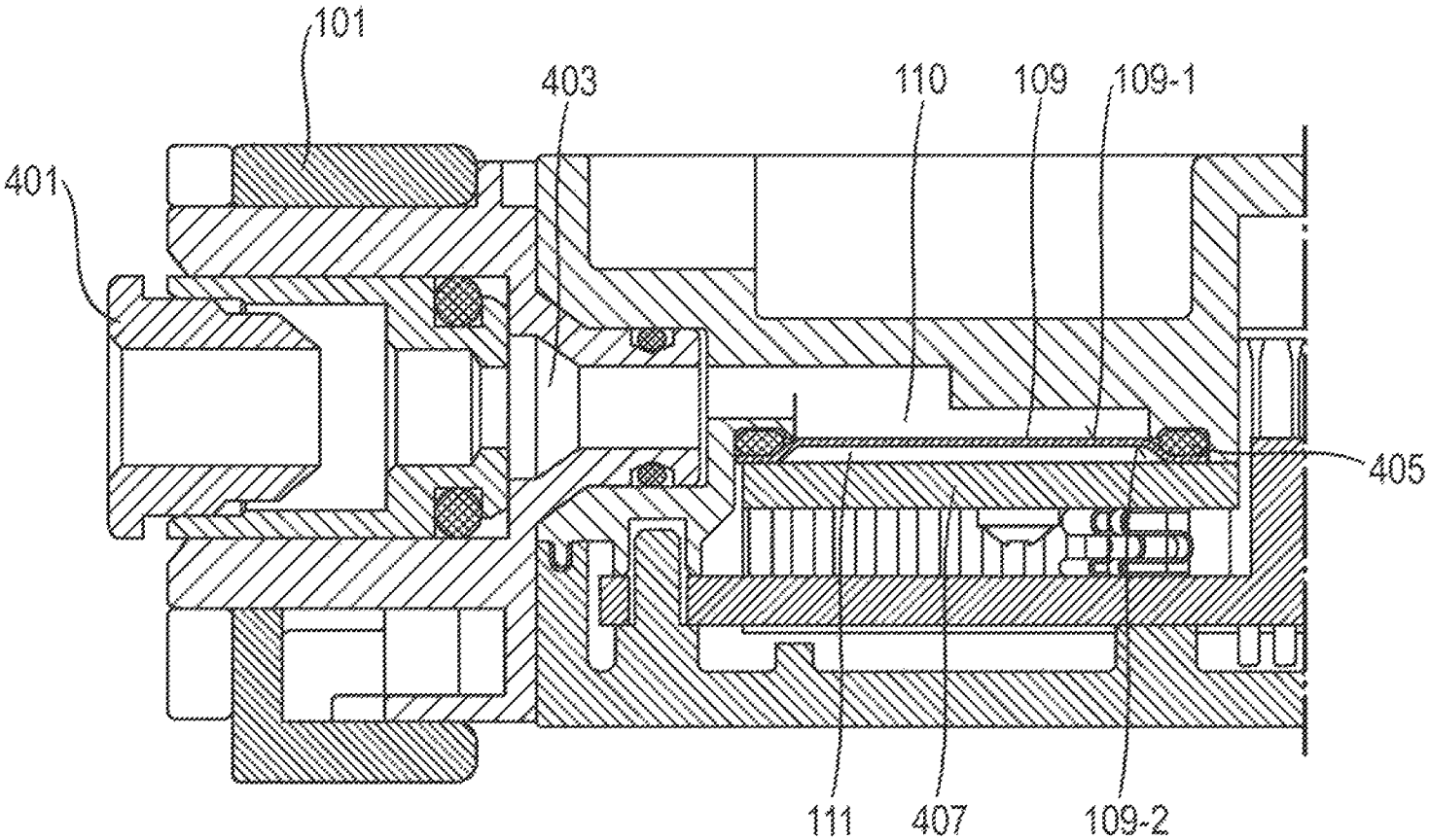
FIG. 4 shows a differential pressure sensor.

FIG. 4 shows an example of an arrangement of the differential pressure sensor 106 in the carcass 101.

The pressure chamber 110 is connected via a pressure port 401 and a pressure line 403, which can comprise line segments of different diameter, to the internal space 105 in a manner that allows the transfer of pressure.

In the exemplary embodiment shown in FIG. 4, the pressure damping chamber 111 has a closed design and thereby forms a separate reference system. For this purpose, the pressure damping chamber 111 comprises side walls 405, which can be implemented by an enclosing seal for example. The side walls 405 are covered by a closure 407, which hermetically seals the inside of the pressure damping chamber 111. Hence a constant reference pressure prevails inside the pressure damping chamber 111, with the result that any pressure variations act only via the first membrane side 109-1.

If, for example in the push scenario, an opening intention is performed by a push on the door 103, then a door movement occurs that can cause a pressure change in the internal space 105 and in the surrounding area. As a result of the closed design of the differential pressure sensor 106, the pressure changes are detected via the first membrane side 109-1. In this case, the differential pressure sensor 106 forms a difference between the detected pressure and the reference pressure prevailing in the pressure damping chamber 111. The effect of the pressure fluctuations in the area around the domestic appliance 100 is thereby reduced.

LIST OF REFERENCES

100 domestic appliance
101 carcass
103 door
105 internal space
106 differential pressure sensor
107 door-opening aid
109 sensor membrane
109-1 first membrane side
109-2 second membrane side
110 pressure chamber
111 pressure damping chamber
113 controller
201 pressure profile
201-1 first pressure profile segment
201-2 second pressure profile segment
203 gradient reversal point
205 boundary
207 boundary
208 differential pressure ceiling value
210 differential pressure ceiling value
301 differential pressure profile
303-3 steeper gradient of the differential pressure profile
303 lower pressure profile boundary
305 upper pressure profile boundary
401 pressure port
403 pressure line
405 side wall
407 closure

The invention claimed is:

1. A domestic appliance, comprising:
a carcass defining an internal space;
a door for closing said internal space;
a differential pressure sensor having a sensor membrane for detecting a pressure difference between an internal air pressure in said internal space and an external air pressure in an external space;
a door-opening aid for assisting a door opening process; and
a controller for controlling said door-opening aid according to the pressure difference detected by the differential pressure sensor, said controller being configured to acquire a pressure profile of the pressure difference, and to control said door-opening aid according to the pressure profile acquired, said controller being configured for detecting a gradient reversal of the pressure profile acquired, and for activating said door-opening aid if the gradient reversal is present.

2. The domestic appliance according to claim 1, wherein said controller is configured to activate said door-opening aid if the pressure profile acquired lies within a predetermined pressure profile corridor.

3. The domestic appliance according to claim 1, wherein said controller is configured to compare a gradient of the pressure profile acquired with at least one gradient threshold value in order to identify whether the pressure profile acquired lies within a predetermined pressure profile corridor, and to activate said door-opening aid only when the pressure profile acquired lies within the predetermined pressure profile corridor.

4. The domestic appliance according to claim 1, wherein said controller is configured to detect a positive gradient of the pressure profile up to the gradient reversal, and to detect a negative gradient of the pressure profile after the gradient reversal, and to activate said door-opening aid only when the positive gradient of the pressure profile and the negative gradient of the pressure profile lie within a predetermined pressure profile corridor.

5. The domestic appliance according to claim 1, wherein said controller is configured to activate said door-opening aid or amplify an effect thereof in an event of an increase in a gradient of the pressure profile.

6. The domestic appliance according to claim 1, wherein said controller is configured to activate said door-opening aid if the pressure profile having negative pressure difference values drops below a pressure profile corridor.

7. The domestic appliance according to claim 1, further comprising a pressure damping chamber; and wherein said sensor membrane has a first membrane side, which faces said internal space and a second membrane side, which faces away from said internal space, and in that said second membrane side is surrounded by said pressure damping chamber, and in that said pressure damping chamber is configured to damp the external air pressure at least partially.

8. The domestic appliance according to claim 7, wherein said differential pressure sensor is disposed in said carcass.

9. The domestic appliance according to claim 7, wherein said pressure damping chamber encloses said second membrane side fully or at least partially.

10. The domestic appliance according to claim 7, wherein said pressure damping chamber is configured to provide a reference pressure or to damp the external air pressure.

11. The domestic appliance according to claim 7, wherein said pressure damping chamber has a pressure damping element provided for monotonic pressure equalization between an interior of said pressure damping chamber and the external space.

12. The domestic appliance according to claim 11, wherein said pressure damping element is a damping orifice or a damping stage.

13. The domestic appliance according to claim 7, wherein said controller has a controller circuit board having an electrical circuit, and in that said controller circuit board forms a wall of said pressure damping chamber or closes said pressure damping chamber.

14. The domestic appliance according to claim 1, wherein said door can be opened by a mechanical push on said door, and said controller is configured to activate said door-opening aid in an event of an increase in a detected pressure difference, or in that said door can be opened by a mechanical pull on said door, and in that said controller is configured to activate said door controller in an event of a reduction in the detected pressure difference.

15. A method for controlling an activatable door-opening aid for assisting an opening of an appliance door in a domestic appliance, the domestic appliance containing a carcass, a door for closing an internal space, a differential pressure sensor having a sensor membrane for detecting a pressure difference between an internal air pressure in the internal space and an external air pressure outside in an external space, which comprises the steps of:

acquiring a pressure profile of the pressure difference within a time interval;

detecting a gradient reversal of the pressure profile acquired; and activating the door-opening aid according to the pressure profile acquired if the gradient reversal is present.

16. The method according to claim 15, which further comprises activating, via a controller, the door-opening aid only when the pressure profile acquired lies within a predetermined pressure profile corridor.

* * * * *